US005303670A

United States Patent [19]

Rantanen

[11] Patent Number: 5,303,670

[45] Date of Patent: Apr. 19, 1994

[54] DEVICE FOR PROPORTIONING OF A COATING AGENT ONTO A MOVING BASE

[75] Inventor: Rauno Rantanen, Muurame, Finland

[73] Assignee: Valmet Paper Machinery Inc., Finland

[21] Appl. No.: 771,427

[22] Filed: Oct. 4, 1991

[30] Foreign Application Priority Data

Oct. 12, 1990 [FI] Finland ..... 905042

[51] Int. Cl.[5] ..... B05C 1/08

[52] U.S. Cl. ..... 118/228; 118/227; 118/250; 118/259; 118/262

[58] Field of Search ..... 118/224, 227, 228, 249, 118/250, 257, 262; 101/350, 351

[56] References Cited

U.S. PATENT DOCUMENTS

| | | | |
|---|---|---|---|
| 2,090,361 | 10/1936 | Steinmetz | 101/351 |
| 2,105,982 | 1/1938 | Massey et al. | 118/227 |
| 2,287,905 | 6/1942 | Richmond et al. | 118/227 |
| 2,749,878 | 6/1956 | Hagen | 118/227 |
| 3,916,824 | 11/1975 | Knodel et al. | 118/262 |
| 4,246,301 | 1/1981 | Alheid et al. | 118/262 |
| 4,290,363 | 9/1981 | Köbler | 101/351 |

*Primary Examiner*—W. Gary Jones
*Assistant Examiner*—Todd J. Burns
*Attorney, Agent, or Firm*—Steinberg, Raskin & Davidson

[57] ABSTRACT

The invention concerns a device for metering of a coating agent onto a moving base, such as a paper or board web. The device includes first and second soft-faced applicator rolls defining a coating nip, through which nip a web is passed. The first applicator roll is journalled as fixed on a frame of the device, and the second applicator roll is linked to the frame of the device pivotally by the intermediate of a loading arm or the equivalent. At least one of the applicator rolls is in nip contact with a hard transfer roll, which is further in nip contact with a soft-faced metering roll. A pond of coating agent is located in a metering nip between the metering roll and a transfer roll. As the rolls revolve, the coating agent is transferred through the metering nip onto the face of the transfer roll and from there further through a transfer nip formed by the transfer roll and the applicator roll onto the face of the applicator roll. From the applicator roll, the coating agent is transferred onto the web in the coating nip. The metering roll and the transfer roll placed next to the fixed applicator roll and/or the metering roll and the transfer roll placed next to the mobile applicator roll are pivotally linked to the same machine member on the frame of the device.

15 Claims, 2 Drawing Sheets

DEVICE FOR PROPORTIONING OF A COATING AGENT ONTO A MOVING BASE

BACKGROUND OF THE INVENTION

For the coating of a moving base, such as a paper board web, with a coating agent, various size presses are commonly used. In size presses, the paper or board web is passed through a nip formed by size press rolls, in which nip the coating agent is transferred onto the face of the paper or board web.

In the prior art, a number of size presses of different types are known, of which one application, which has been in use for a long time, is one in which the rolls in the size press are arranged substantially on the same horizontal level so that the paper or board web runs through the size press nip substantially vertically from the top downwards. In such an application, as a rule, in the nip between the size press rolls, there is a size pond, through which the paper or board web runs. When the web passes through the pond, the size adheres to both sizes of the web, whereupon, in the nip, the size press rolls spread and smooth layers of suitable thickness onto the web faces.

A second embodiment of a size press is one in which, by means of some suitable coating means, such as bar or blade coaters, size films of suitable thickness are first spread onto the faces of the size press rolls, from which said size films are then transferred onto the web faces in the roll nip. A third prior art embodiment of a size press is a so-called gate roll size press, which is, in two-sided surface sizing of a paper, composed of size rolls, which are in nip contact with each other. A gate roll size press first comprises applicator rolls proper, the web being passed through the nip between said rolls. Size films are spread onto the faces of said applicator rolls by means of gate rolls, which comprise a metering roll and a transfer roll. The transfer roll is in nip contact both with the metering roll and with the applicator roll proper. The coating agent is fed into the nips between the gate rolls, i.e. between the metering rolls and the transfer rolls, where it forms a pond. From both ends of the ponds, as a rule, an overflow is provided to the return circuit. By the effect of hydrodynamic forces, coating agent passes through the nip between the metering rolls and the transfer rolls, forming size films both on the metering rolls and on the transfer rolls. The size film placed on the transfer roll is transferred into the nip between the transfer roll and the applicator roll, which nip smooth and thins the film onto the applicator roll. In the nip between the applicator rolls, the film are transferred further onto the web.

The present invention is expressly related to the size presses of the last-mentioned gate roll type. The construction of conventional gate roll size presses is usually such that one of the applicator rolls is journalled fixedly on the size press frame, whereas the other applicator roll is arranged displaceable so that its bearing bracket is linked pivotally to the frame of the size press. The transfer roll that is in nip contact with the fixed applicator roll is linked pivotally to the size press frame by the intermediate of a loading arm and, further, the metering roll that is in nip contact with said transfer roll is linked pivotally to the size press frame by the intermediate of a loading arm and, further, the metering roll that is in nip contact with said transfer roll is linked pivotally to the bearing bracket or loading arm of the transfer roll by the intermediate of its own loading arm. In a corresponding way, in conventional solutions, the transfer roll that forms a nip with the displaceable applicator roll is linked pivotally to the bearing bracket or loading arm of the applicator roll by the intermediate of its own loading arm or by its bearing bracket and, further, the metering roll that is in nip contact with said transfer roll is linked pivotally to the bearing bracket or loading arm of the transfer roll. On the other hand, the loading cylinders of each roll are linked to the loading arm of search roll and, at the opposite end, to the machine member to which the roll concerned is linked pivotally.

In wide and high-speed paper machines in particular, the prior art solutions are associated with considerable problems of vibration of the gate rolls, resulting from the mode of linkage of conventional gate rolls. For example, the metering roll at the side of the displaceable applicator roll, i.e. the outermost roll in the system, is fixed to the frame by the intermediate of a chain formed by three separate articulated joints. By means of the construction concerned, it is very difficult to provide a sufficiently rigid fastening of the rolls in view of vibrations. Besides wear of the constructions of the frame, the vibrations also cause quality defects in the coating band an increased wear of the roll coatings. The wear of the roll coatings is one of the most important problems of the gate roll size presses.

OBJECTS AND SUMMARY OF THE INVENTION

An object of the present invention is to provide an improvement over the construction of the prior art size presses.

Accordingly, the present invention is related to a device for metering of a coating agent onto a moving base, such as a paper or board web. The device comprises a coating nip formed by soft-faced applicator rolls, through which nip the web is passed. A first applicator roll from among a plurality of applicator rolls is journalled as fixed on a frame of the device. A second applicator roll is linked to the frame of the device pivotally by the intermediate of a loading arm or equivalent. At least one of said applicator rolls is in nip contact with a hard transfer roll. The hard transfer roll is further in nip contact with a soft-faced metering roll, whereby, in a metering nip between the metering roll and the transfer roll, a pond comprising a coating agent is located. As the rolls revolve, the coating agent from the pond is fitted to be transferred through the metering nip onto the face of the transfer roll and from there further, through a transfer nip formed by the transfer roll and the applicator roll, onto the face of the applicator roll from which the coating agent is fitted to be transferred onto the web in the coating nip.

An important aspect of the device in accordance with the invention is that the metering roll and the transfer roll placed next to the fixed applicator roll and/or the metering roll and the transfer roll placed next to the mobile applicator roll are linked pivotally to the same member of the machine on the frame of the device.

By means of the device in accordance with the invention, a number of remarkable advantages are obtained over the prior art devices. It is one important advantage of the invention that the construction in accordance with the invention is considerably less susceptible to vibrations, because of the mode of linkage of the rolls. Moreover, in the invention, the regulation of the linear loads in the nips in the size press can be accomplished considerably more accurately than in the prior art solutions.

A further remarkable advantage obtained by the invention is that it is now possible to employ adjustable-crown rolls without the associated problems with the same found in the prior art. In particular, adjustable-crown rolls were not employed in the prior art gate roll size press constructions, partly because of the high weight of the rolls.

By means of the adjustable crown metering rolls employed in conjunction with the present invention, it is readily possible to regulate the profile of the coating quantity during operation of the machine. In contrast, in conventional size processes (in which an adjustable crown roll could not be used), the profile of coating quantity could be affected exclusively by means of the camber of the rolls.

Further advantages and characteristic features of the invention are set forth in the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1:
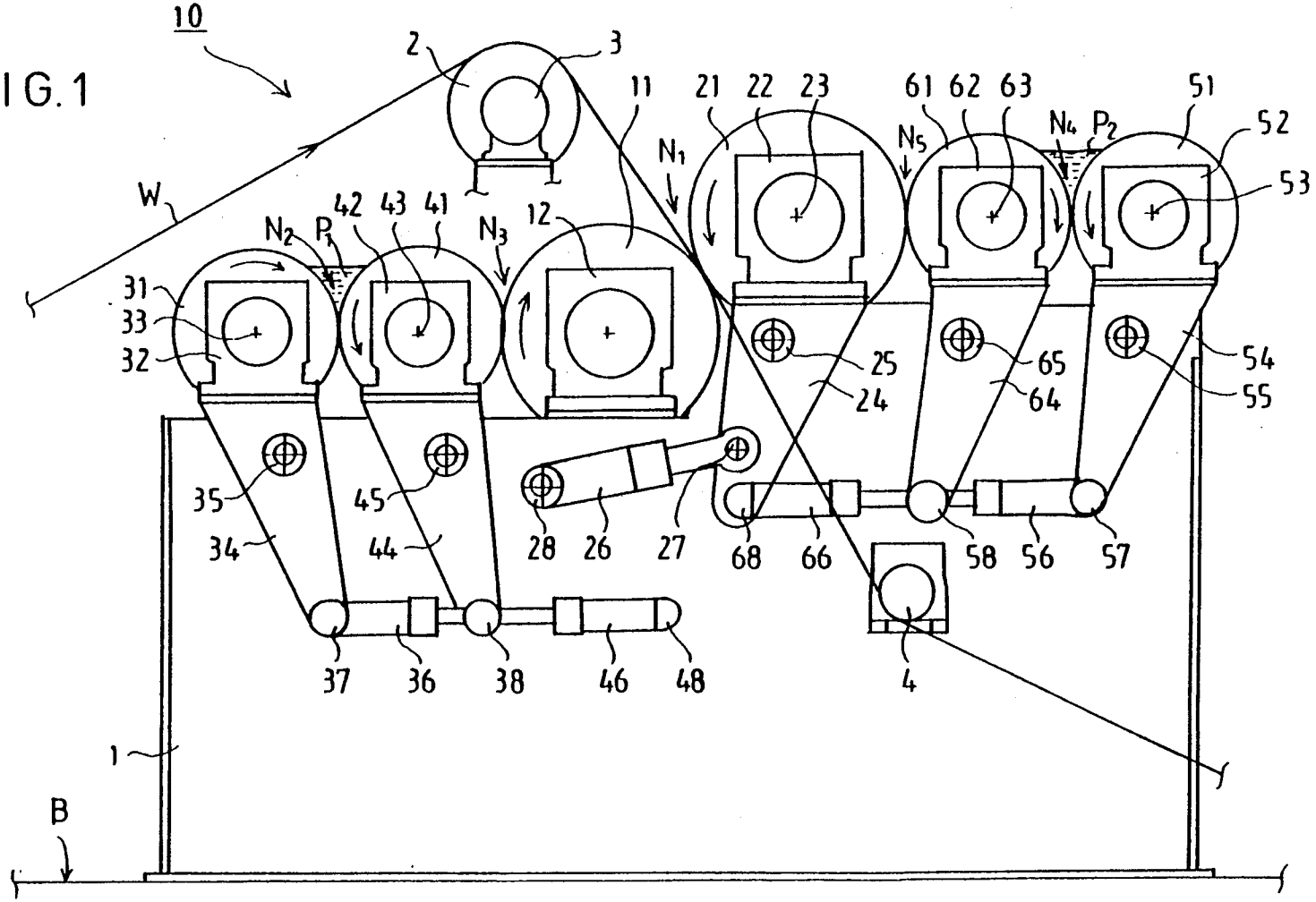
FIG. 1 is a schematic side view of a first embodiment of the device in accordance with the invention.

In FIG. 1, the device in accordance with the invention is denoted generally with the reference numeral 10. The device 10 comprises a frame 1, which is mounted on a foundation B, e.g. a floor. Applicator rolls 11,21 have been mounted on the frame 1, of which rolls the bearing bracket 12 of the first applicator roll 11 is mounted on the frame 1 in a stationary manner. The bearing 12 of the first applicator roll 11 is mounted on the frame 1 in a stationary manner, whereas the bearing bracket 22 of the second applicator roll 21 is mounted on an applicator roll loading arm 24, which is mounted on the frame 1 pivotally by means of an articulation shaft 25 transverse to the machine direction.

The applicator rolls 11,21 define a coating nip $N_1$ between them, through which nip the web W is passed. The web W is passed onto the coating nip $N_1$ guided by a leading roll 2, and after the coating nip $N_1$ the web W is passed to further processing as guided by a guide roll 4. The bearing bracket 3 of the leading roll 2 is supported on the frame 1 in a suitable way, but, for the sake of clarity of the illustration, these constructions are not shown in FIG. 1.

At the side of the stationary applicator roll, i.e. the first applicator roll 11, gate rolls are provided in the device 10, which gate rolls comprise a first metering roll 31 as well as a first transfer roll 41. The first metering roll 31 and the first transfer roll 41 are in nip contact with one another and define a first metering nip $N_2$ between them. Correspondingly, the first transfer roll 41 is in nip contact with the first applicator roll 11, while these rolls define a first transfer nip $N_3$ between them. The coating agent is fed into the first metering nip $N_2$ so that a first point $P_1$ is formed in said nip out of the coating agent. By the effect of hydrodynamic forces, coating agent passes through the first metering nip $N_2$ so that films of coating agent are formed on the faces of the first metering roll 31 and the first transfer roll 41. When the rolls revolve, the film placed on the face of the first transfer roll 41 is transferred into the first transfer nip $N_3$, which smooths and thins the film onto the face of the first applicator roll 11. In the coating nip $N_1$ the film is then transferred from the face of the first applicator roll 11 onto the web W.

The bearing bracket 32 of the first metering roll 31 is mounted on a first metering roll loading arm 34, which is supported on the frame 1 of the device pivotally by means of an articulation shaft 35 transverse to the machine direction. In a corresponding way, the bearing bracket 42 of the first transfer roll 41 is also mounted on a first transfer roll loading arm 44 of its own, which is supported on the frame 1 of the device pivotally in a corresponding way by means of an articulation shaft 45 transverse to the machine direction.

In the first transfer roll loading arm 44 a loading cylinder 46 is attached by means of an articulated joint, and the opposite end 48 of said cylinder 46 is supported on the frame 1. The first metering roll loading arm 34 is also provided with a loading cylinder 36, the first end 37 of which is attached to said loading arm 34 by means of an articulated joint, whereas the other end 38 of the first metering roll loading cylinder 36 is attached to the first transfer roll loading arm 44.

In the embodiment shown in FIG. 1, the parts of the loading arms 34 and 44 of the first metering roll 31 and the first transfer roll 41 that are placed at the side of the rolls, i.e. the distances between the articulation shafts 35 and 45 and the axes of rotation 33 and 43 of the rolls are equally large as compared with one another and, in a corresponding way, the parts of the loading arms 34 and 44 placed at the side of the loading cylinders 36,46, i.e. the distances between the articulation points 37,48 of the loading cylinders 3 and 46 and the articulation shafts 35,45 of the loading arms are equally large as compared with one another.

Such an embodiment can be considered optimal for the invention, for in such a case, any adjustments taking place in the linear loads in the first metering nip $N_2$ and the first transfer nip $N_3$ do not affect each other, and opening or closing of the transfer nip $N_3$ does not produce a change in the length of the loading cylinder 36 or, thus, a pulse in the linear load of the metering nip $N_2$. Such a pulse in the linear load would occur if there were a change in the stroke length of the loading cylinder 36.

As stated above, the bearing bracket 22 of the second applicator roll 21 is mounted on the applicator roll loading arm 24, which is supported on the frame 1 of the device by means of an articulation shaft 25 transverse to the machine direction. The applicator loading arm 24 is provided with a loading cylinder 26, which is, at its first end 27, attached to said applicator roll loading arm 24 by means of an articulated joint and, at its second end 28, to the frame 1 of the device. The second transfer roll 61, which forms the second transfer nip $N_5$ together with the second applicator roll 21, is supported on the frame 1 in a way similar to the first transfer roll 41. Thus, the bearing bracket 62 of the second transfer roll 61 is mounted on the second transfer roll loading arm 64, which is mounted pivotally on the frame 1 by means of an articulation shaft 65 transverse to the machine direction.

In a corresponding way, the second metering roll 51, which forms the second metering nip N. together with the second transfer roll 61, is supported on the frame 1 so that the bearing bracket 52 of said metering roll is mounted on a second metering roll loading arm 54 of its own, which is mounted on the frame 1 by means of an articulation shaft 55 transverse to the machine direction.

The second meter roll loading arm 54 is provided with a loading cylinder 56, whose first end 57 is linked to said second metering roll loading arm 54 by means of an articulated joint, whereas its second end 58 is linked to the second transfer roll loading arm 64 of by means of an articulated joint.

In a corresponding way, the second transfer roll loading arm 64 is provided with a loading cylinder 66 of its own, which is supported on the loading arm by means of an articulated joint at the same point with the second end 58 of the loading cylinder of the second metering roll. In a corresponding way, the second end 68 of the loading cylinder of the second transfer roll is linked to the applicator roll loading arm 24 by means of an articulated joint.

The dimensional proportions of the loading arms 24,64,54 have been arranged so that the parts of each of the loading arms placed at the side of the rolls, i.e. the parts between the axes of rotation 23,53,63 of the rolls and the articulation shafts 25,55,65, are equally large as compared with each other. In a corresponding way, the parts of the loading arm 24,64,54 placed at the side of the loading cylinders, i.e. the parts between the articulation shafts 25,65,55 and the articulation points 57,58,68 of the loading cylinders 56,66 are equally large as compared with each other. Owing to the mutual proportions of the dimensioning of the parts of the loading arms 24,54,64 in this case as well, adjustments taking place in the linear loads in the various nips $N_1$,$N_4$,$N_5$ and/or opening and closing of the nips do not affect the linear loads in other nips.

Typical linear loads in the various nips are, e.g. in the nips $N_2$,$N_5$ between transfer rolls and applicator rolls from about 10 to about 30 kN/m, and in the nips $N_1$ between applicator rolls from about 25 to about 40 kN/m. All the rolls 11,21,31,41,51,61 in the device 10 are separate driven. Separately drive is needed, because the speeds of rotation of the rolls are different. In particular, in a situation in which the transfer rolls 41,61 are smooth-faced rolls, typical circumferential velocities of the rolls in relation to the web speed are on the applicator rolls 11,21 about 100% of the web speed, on the transfer rolls 41,61 about 80% of the web speed, and on the metering rolls 31,51 about 25% of the web speed. Owing to the separate drives of the rolls, the roll speeds can also be regulated individually when desired.

The metering rolls 31,51 and the applicator rolls 11,21 are coated rolls. The metering rolls 31,51 are provided with a coating of rubber or equivalent, and the applicator rolls 11,21 are, as a rule, provided with rubber or polyurethane coating.

The transfer rolls 41,61 are hard rolls, and, in view of improving the wear resistance, they are commonly provided with a hard coating, in particular chromium coating.

In order to improve the wear resistance further, in a size press in accordance with the invention, on the transfer rolls 41,61, it is possible to employ a ceramic coating, whose wear resistance is very good. Instead of smooth-faced transfer rolls 41,61, it is also possible to employ mat-faced transfer rolls, in which case, the circumferential velocities of the various rolls in the size press are, as a rule, substantially equal to reduce the wear of the roll coatings.

Besides the reduced susceptibility of vibration, a remarkable advantage of the mode of linkage of the rolls illustrated in FIG. 1, compared with the prior art, is the fact that the control of the loading cylinders can be arranged precise, because the roll weights do not have an essential effect on the linear loads. The linear loads in each of the nips $N_1$–$N_5$ in the size press shown in FIG. 1 can be regulated individually by means of the loading cylinders 26,36,46,56,66 so that adjustments of the linear loads in the various nips have no effect on the linear loads in the other nips. The embodiment as shown in FIG. 1 can be also accomplished so that each of the loading cylinders 36,46,56,66 of the gate rolls, i.e. metering rolls 31,51 and the transfer rolls 41,61 is linked directly to the frame 1 of the size press. In such case, the size press rolls communicate with each other exclusively through the frame 1 of linkage of the loading cylinders, however, requires a substantially more accurate and precise system of regulation of the loading cylinders, because the adjustments made in the linear loads in the various nips also affect the linear loads in the other nips. The mode of linkage of the rolls as shown in FIG. 1 also makes it easily possible to employ adjustable-crown rolls as the metering rolls 31,51.

In conventional gate roll size press constructions, it has not been possible to employ adjustable-crown rolls as metering rolls, because their weight is considerably high as compared with ordinary rolls. By means of adjustable-crown metering rolls 31,51 it is easily possible to regulate the profile of coating quantity during operation of the machine. In conventional gate roll size presses, the profile of coating quantity can be affected during operation but regrinding of the rolls.

Figure 2:
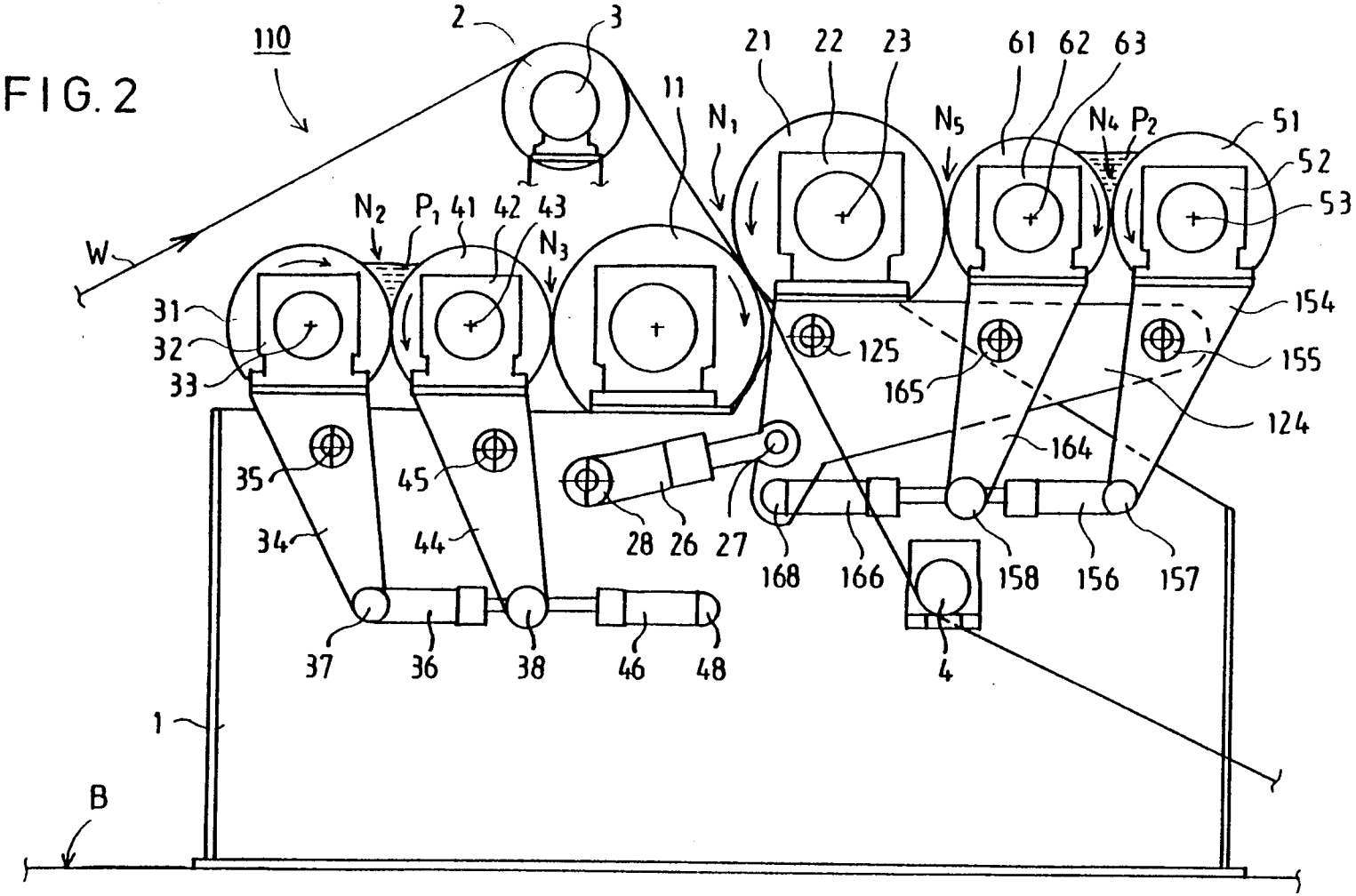
FIG. 2 is an illustration corresponding to FIG. 1 of a second embodiment of the device in accordance with the invention.

In FIG. 2, a second embodiment of the invention is illustrated. The device shown in FIG. 2 is denoted generally with the reference numeral 11. In respect to the first applicator roll 11 and the gate rolls 31,41 placed at the side of the first applicator roll, the embodiment of FIG. 2 is identical with FIG. 1, and therefore the same reference numerals are used for corresponding components. Thus, the embodiment of FIG. 2 differs from FIG. 1 in respect of the linkage of the second applicator roll 21 and the gate rolls 51,61 placed at the side of said second applicator roll. The applicator roll loading arm 124 is linked to the frame 1 of the device 110 by means of an articulation shaft 125 transverse to the machine direction in a way similar to that used in the embodiment of FIG. 1. Further, the linkage of the loading cylinder 26 both to the frame 1 of the device and to the applicator roll loading arm 124 corresponds to FIG. 1.

In the embodiment of FIG. 2, the second metering roll loading arm 154 and second transfer roll loading arm 164 have not been linked directly to the machine frame 1 in a way corresponding to FIG. 1, but in the embodiment of FIG. 2, the arrangement is such that the second metering roll loading arm 154 and the second transfer roll loading 164 are linked to the applicator roll loading arm 124 by means of articulation shafts 155, 165 transverse to the machine direction.

The mode of linkage of the loading cylinders 156 and 166 of the second metering roll 51 and the second transfer roll 61 is similar to that shown in FIG. 1, so that the first end 157 of the loading cylinder 156 of the second metering roll 51 is linked to the second metering roll loading arm 154, and its second end 158 is linked to the second transfer roll loading arm 164.

In a corresponding way, one end of the loading cylinder 166 of the second transfer roll 61 is linked to the applicator roll loading arm 124, whereas the opposite end is linked to the second transfer roll loading arm 164 on the same articulation shaft with the loading cylinder 156 of the second metering roll 51.

In a corresponding way, one end of the loading cylinder 166 of the second transfer roll 61 is linked to the loading arm 124 of the second applicator roll 21, whereas the opposite end is the metering rolls 51, 61 are the side of the second applicator roll articulation shaft 125, but the coating nip $N_1$ can be readily opened to a higher extent than in the embodiment of FIG. 1 to facilitate the replacement of the second applicator roll.

The embodiments shown in FIGS. 1 and 2 can also be used for one-sided coating of the web W. In such a case, as compared with FIGS. 1 and 2, the solution has been simplified so that, for example, the gate rolls 31 and 41 at the side of the first applicator roll 11 are omitted completely in the solution. In such a case, in the coating nip $N_1$, the size film that is applied from the second size pond $P_2$ through the second metering nip $N_4$ and the second transfer nip $N_5$ onto the face of the applicator roll 21 and from it further into the coating nip $N_1$ is spread onto one side of the web W only. In such a solution as well, by means of the suspension of the gate rolls, the same advantages are achieved as in the embodiments shown in FIGS. 1 and 2.

The device in accordance with the invention may be modified in many ways from what is shown in the figures in the drawing. Thus, compared with the figures, the run of the web W may be arranged in the opposite direction, i.e. so that the web W runs from below upwards. In such a case, of course, the senses of rotation of the rolls 11,21,31,41,51,61 are opposite to those shown in the figures, and the ponds $P_1$,$P_2$ of coating agent have also been arranged below the metering nips $N_2$, $N_4$.

Further, an alternative embodiment different from the figures is one in which the transfer rolls 41,61 are not loaded separately, but the linear loads in the transfer nips $N_3$,$N_5$ are provided by means of loading of the metering rolls 31,51. In such a case, differing from the figures, the loading cylinder 36 of the first metering roll 31 is linked, by one of its ends, directly to the frame 1 of the size press, and the loading cylinder 46 of the first transfer roll 41 has been omitted in the construction.

In a corresponding way, in such a case, the loading cylinder 56,156 of the second metering roll 51 is linked, by one of its end, to the applicator loading arm roll 24, 124 or directly to the frame 1 of the size press. In such a case, of course, the loading cylinder 66 or 166 of the second transfer roll 61 has been omitted in the construction. Then, the linear loads can, however, not be regulated equally individually as in the embodiments shown in the figures.

Above, the invention has been described by way of example with reference to the figures in the drawing. The examples provided above are not meant to be exclusive. Many other variations of the present invention would be obvious to those skilled in the art, and are contemplated to be within the scope of the appended claims.

What is claimed is:

1. A device for metering a coating agent onto a moving base, such as a paper or board web, comprising a frame, first and second soft-faced applicator rolls defining a coating nip through which nip a web is passed, said first applicator roll being journalled as fixed on said frame, said second applicator roll being pivotally linked to said frame by an intermediate part of an applicator loading arm, a first hard transfer roll defining a first transfer nip with said first soft-faced applicator roll, a first soft metering roll, said first hard transfer roll defining a first metering nip with said first soft metering roll, a first pond comprising a coating agent located at said first metering nip, said coating agent being transferred through said first metering nip onto a face of said first hard transfer roll and through said first transfer nip onto a face of said first applicator roll such that said coating agent is transferred onto said web in said coating nip, said first soft-faced metering roll and said first hard transfer roll being pivotally linked to a same member of said frame; and means for individually regulating linear loads in each of said coating, transfer and metering nips to enable adjustments of said linear loads in each nip without affecting the linear loads of said other nips.

2. The device of claim 1, further comprising a second hard transfer roll defining a second transfer nip with said second soft-faced applicator roll, a second soft metering roll, said second hard transfer roll defining a second metering nip with said second soft metering roll, a second pond comprising a coating agent located at said second metering nip, said coating agent being transferred through said second metering nip onto a face of said second hard transfer roll and through said second transfer nip onto a face of said second applicator roll such that said coating agent is transferred onto said web in said coating nip, said second soft-faced metering roll and said second hard transfer roll being pivotally linked to a same second member of said frame.

3. The device of claim 2, wherein said first metering roll is mounted on a first metering roll loading arm and said first transfer roll is mounted on a first transfer roll loading arm, intermediate parts of said first metering roll and said first transfer roll loading arms being linked to said frame.

4. The device of claim 3, wherein said second metering roll is mounted on a second metering roll loading arm and said second transfer roll is mounted on a second transfer roll loading arm, intermediate parts of said second metering roll and said second transfer roll loading arms being pivotally linked directly to said frame.

5. A device for metering a coating agent onto a moving base, such as a paper or board web, comprising a frame, first and second soft-faced applicator rolls defining a coating nip through which nip a web is passed, said first applicator roll being journalled as fixed on said frame, said second applicator roll being pivotally linked to said frame by an intermediate part of an applicator roll loading arm, a first hard transfer roll defining a first transfer nip with said first soft-faced applicator roll, a first soft metering roll, said first hard transfer roll defining a first metering nip with said first soft metering roll, a first pond comprising a coating agent located at said first metering nip, said coating agent being transferred through said first metering nip onto a face of said first hard transfer roll and through said first transfer nip onto a face of said first applicator roll such that said coating agent is transferred onto said web in said coating nip, said first soft-faced metering roll and said first hard transfer roll being pivotally linked to a same member of said frame, a second hard transfer roll defining a second transfer nip with said second soft-faced applicator roll, a second soft metering roll, said second hard transfer roll defining a second metering nip with said second soft metering roll, a second pond comprising a coating agent located at said second metering nip, said coating agent being transferred through said second metering nip onto a face of said second hard transfer roll and through said second transfer nip onto a face of said second applicator roll such that said coating agent is transferred onto said web in said coating nip, said second soft-faced metering roll and said second hard transfer roll being pivotally linked to a same second member of said frame, said first metering roll being mounted on a first metering roll loading arm and said first transfer roll being mounted on a first transfer roll loading arm, intermediate parts of said first metering and said first transfer loading arms being linked directly to said frame;

said second metering roll being mounted on a second metering roll loading arm and said second transfer roll being mounted on a second transfer roll loading arm, intermediate parts of said second metering and said second transfer loading arms being pivotally linked directly to said frame; and wherein said second metering roll and said second transfer roll are linked to said applicator roll loading arm by said intermediate parts of said second metering roll and second transfer roll loading arms, respectively.

6. The device of claim 5, wherein said first metering roll and first transfer roll loading arms are provided with loading cylinders linked to said loading arms, said loading cylinder of said first metering roll loading arm being linked by a first end to said first transfer roll loading arm of said transfer roll loading arm being linked by a first end directly to said frame.

7. The device of claim 6, wherein said second metering roll and second transfer roll loading arms are provided with loading cylinders linked to said loading arms so that the loading cylinder of said second metering roll loading arm is linked to said second transfer roll loading arm at one end, and the loading cylinder of said second transfer roll loading arm is linked at one end to said applicator roll loading arm.

8. The device of claim 6, wherein said second metering roll and second transfer roll loading arms are provided with loading cylinders linked to said loading arms, each of said loading cylinders being linked directly to said frame.

9. The device of claim 6, wherein articulation shafts pivotally support said second applicator roll, second metering roll and second transfer roll loading arms on said frame in a transverse direction, the distances between each of said articulation shafts and center points of said second applicator roll, second metering roll, and second transfer roll respectively, being substantially equal, and the distances between said articulation shafts of said second applicator roll, second metering roll and second transfer roll loading arms and articulation points of the loading cylinders of said second applicator roll, second metering roll and second transfer roll loading arms respectively are substantially equal.

10. The device of claim 9, wherein articulation shafts pivotally support said first metering roll and first transfer roll loading arms on said frame in a transverse direction, the distances between each of said articulation shafts and center points of said first metering roll and said first transfer roll respectively are substantially equal, and the distances between said articulation shafts of said first metering roll and first transfer roll loading arms and articulation points of the loading cylinders of said first metering roll and said first transfer roll loading arms respectively are substantially equal.

11. The device of claim 10, wherein the linear loads in all the nips between the rolls are separately adjustable.

12. The device of claim 11, wherein said metering rolls are adjustable-crown rolls.

13. The device of claim 10, wherein said web is arranged to run through said coating nip from the top downwards, said ponds being formed above said metering nips.

14. The device of claim 10, wherein said web is arranged to run through said coating nip from below upwards.

15. The device of claim 5, wherein said first metering roll and first transfer roll loading arms are provided with loading cylinders linked to said loading arms, said loading cylinders being linked at their opposite ends directly to said frame.

* * * * *